United States Patent [19]

Ishikawa et al.

[11] Patent Number: 4,900,510

[45] Date of Patent: Feb. 13, 1990

[54] HIGH STRENGTH AND CORROSION RESISTANT TITANIUM ALLOY HAVING EXCELLENT CORROSION-WEAR PROPERTIES

[75] Inventors: Misao Ishikawa; Yohji Kohsaka; Chiaki Ouchi; Katsumi Masamura, all of Tokyo, Japan

[73] Assignee: Nippon Kokan Kabushiki Kaisha, Tokyo, Japan

[21] Appl. No.: 181,215

[22] Filed: Apr. 13, 1988

[30] Foreign Application Priority Data

Apr. 22, 1987 [JP] Japan ..... 62-97575

[51] Int. Cl.[4] ..... C22C 15/00

[52] U.S. Cl. ..... 420/418; 420/421

[58] Field of Search ..... 420/418, 421

[56] References Cited

U.S. PATENT DOCUMENTS

| | | | |
|---|---|---|---|
| 3,540,946 | 11/1970 | Minton et al. | 420/418 |
| 3,666,453 | 5/1982 | Goosey | 420/418 |
| 4,634,478 | 1/1987 | Shimogori et al. | 420/421 |
| 4,737,341 | 4/1988 | Barber | 420/418 |

*Primary Examiner*—Upendra Roy

*Attorney, Agent, or Firm*—Moonray Kojima

[57] ABSTRACT

A high strength and corrosion resistant titanium alloy having excellent corrosion-wear properties may be prepared in that Al and Mo are added as alloying elements in specific amounts, and if Zr in a specific amount is further added, the strength and the corrosion-wear properties would be more improved.

1 Claim, 1 Drawing Sheet

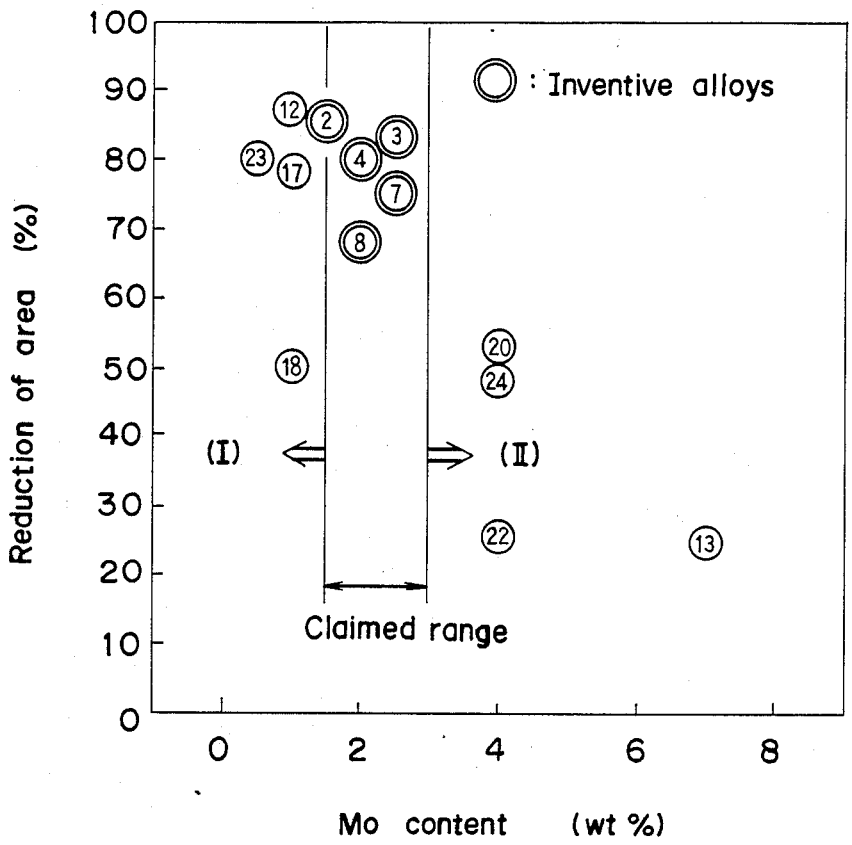
100
90
80
70
60
50
40
30
20
10
0
Reduction of area (%)
: Inventive alloys
12
2
3
23
17
4
7
8
18
20
24
(I)
(II)
22
13
Claimed range
0
2
4
6
8
Mo content (wt %)

HIGH STRENGTH AND CORROSION RESISTANT TITANIUM ALLOY HAVING EXCELLENT CORROSION-WEAR PROPERTIES

FIELD OF THE INVENTION

The present invention relates to high strength and corrosion resistant titanium alloy having excellent corrosion-wear properties. Al and Mo are added as alloying elements in specific amounts for providing the excellent strength, the corrosion-wear resistant properties and hot workability.

If Zr in a specific amount is further added, the strength and the corrosion-wear properties would be improved more.

BACKGROUND OF THE INVENTION

Titanium and titanium alloys have excellent corrosion resistance against chloride solution, and are broadly used as structural materials against seawater environments, chemical plants and others. On the other hand, crevice corrosion easily occurs in the chloride solution at high temperature, and this fact limits use of titanium materials. Ti-0.2%Pd alloy and Ti-0.8%Ni-0.3%Mo alloy have been developed in this respect (Japanese Patent Application Laid Open No. 130,614/75), are now utilized. However these titanium alloys are lower in strength than Ti-6Al-4V alloy which has been most widely used as high strength titanium alloy, and the titanium alloys are accordingly restricted with respect to application to parts requiring high strength.

Recently, studies have been made on high strength titanium alloy concerning the applications to oceanic developments, geothermal energy development, medical fields and so on. However, sometimes corrosion resistance is not excellent and examples of corrosion have been reported. In the medical field, titanium alloy is more satisfied with corrosion and stress corrosion resistant characteristics in the chloride environments than stainless steels and Co-Cr-Mo alloys, and further advantageously it does not contain harmful elements to human bodies such as Ni, Co and Cr. Now Ti-6 Al-4V (ELI) has been commercialized. But this kind of titanium alloy could not be satisfied with the corrosion resistance and corrosion-wear properties, and its toxicity in the human bodies is pointed out. The corrosion-wear properties is referred to concerning the wear of the material applied to hip prosthesis in the human bodies under the corrosion environment, and this characteristic is important in this kind of the application, since powders resulting from wear are harmful to the tissue of the human bodies. But titanium alloy is inferior in the wear resistant properties than stainless steel (SUS 316L) and Co-Cr-Mo alloy already used as the hip prosthesis.

U.S. Pat. No. 4,040,129 specifies elements to be contained in broad range, but it is found in examples that investigations are not made in detail and disclosures are insufficient with respect to the hot workability, the corrosion-wear property and the characteristics of the human body in the corrosion circumstances.

As seen from the above, in the conventional titanium alloy, the corrosion resistance could be improved in Ti-0.2Pd alloy and Ti-0.8Ni-0.3Mo alloy, while the strength is still required. On the other hand, the corrosion resistance and the corrosion-wear properties are inferior in Ti-6Al-4V (ELI) of the high tensile titanium alloy.

The present invention has been conducted in view of the existing problems, and it is an object of the invention to provide a high strength and corrosion resistant titanium alloy which has the equivalent strength to that of Ti-6Al-4V (ELI) alloy and especially which could well satisfy the corrosion-wear property and suitability to the human body.

SUMMARY OF THE INVENTION

For accomplishing this object, the invention specifies the chemical composition of Al: 3.0 to 6.0 wt%, Mo: more than 1.5 wt% to less than 3.0 wt%, and the balance being Ti and unavoidable impurities.

This invention could further add Zr: 2.0 to 6.0 wt%, thereby to more improve the strength and the corrosion-wear properties.

BRIEF DESCRIPTION OF THE DRAWING

The sole FIGURE shows influences of Mo contents to the hot workability (reduction of area).

DETAILED DESCRIPTION OF PREFERRED EMBODIMENT

The inventors designed as follows the titanium alloy which could satisfy the above mentioned characteristics.

For providing the titanium alloy which has the high strength and is balanced with strength and ductility, a microstructure consists of $\alpha+\beta$ structure for which Al and Mo are added, Al being $\alpha$ phase stabilizing element, and Mo being $\beta$ phase stabilizing element. The $\alpha+\beta$ structure is stable at room temperature. Al and Mo greatly attribute to the strength, but Al of more than 8 wt% forms a brittle phase called $\alpha_2$ and deteriorates mechanical properties. Mo is effective to the corrosion resistance and the crevice corrosion resistance. Zr could increase precipitation of $\alpha_2$ and enhance the strength without deteriorating the ductility and the corrosion resistance.

The present invention expels alloying elements such as Ni, Co, Cr, V considered to be harmful to the human body, and employs Ti-Al-Mo alloys and Ti-Al-Mo-Zr alloys suitable to the human body by a tissue reaction test. This fact takes into account application to the material for the human body such as the hip prosthesis and has an effect to improving of the corrosion-wear properties by addition of Mo and Zr.

Features of the composition will be further discussed hereinbelow.

Al is $\alpha$ phase stabilizing element for providing an $\alpha+\beta$ phase at a heating temperature about 920° C., and attributes to increasing of the strength without deteriorating the corrosion resistance. A content of less than 3.0 wt% is insufficient to obtain a desired strength, while more than 6.0 wt% causes $\alpha_2$ phase to precipitate and deteriorate the tensile property. So, Al is determined to be 3.0 to 6.0 wt%.

Mo is $\beta$ phase stabilizing element, and broadens the range of the $\alpha+\beta$ phase at a heating temperature about 920° C. and brings about equiaxed $\alpha$ structure having well strength and ductility. Mo is solute in titanium and attributes to strengthening. In addition, it is effective to the corrosion resistance and the crevice corrosion resistance. The corrosion-wear property is also improved by addition of Mo. A content of less than 1.5 wt% is insufficient to obtain a desired strength and the corrosion-wear property.

More than 3.0 wt% deteriorates the hot workability. Thus, for making the $\alpha+\beta$ titanium structure by adding Al and Mo, if Mo is more than 3.0 wt%, the hot workability is required for giving enough hot working strain in the $\alpha+\beta$ range. As a result, it would be difficult to obtain the equiaxed structure having well balanced strength and ductility.

For the above reasons, the Mo content is determined to be more than 1.5 wt% to less than 3.0 wt%.

Zr is a $\beta$ phase stabilizing element, and it does not have a strengthening effect to an extent of Mo but increases strength without lowering ductility, and does not deteriorate the corrosion resistance. Further, the corrosion-wear property is improved. A content of less than 2.0 wt% is insufficient to obtain a desired strength and an effect of improving corrosion-wear property. More than 6.0 wt% would not bring about a desired effect. Therefore, the Zr content is determined to be 2.0 to 6.0 wt%.

EXAMPLE

With respect to each of titanium alloys listed in Table 1, a button ingot was prepared in an Ar arc furnace, forged and hot-rolled to a plate having thickness of 10 mm. Subsequently the plate was subjected to a recrystallization annealing at a temperature of $\alpha+\beta$ heating range, a tensile test, a corrosion-wear test, a polarization characteristic test, a crevice corrosio test, and a tensile test at high speed and high temperature.

The polarization measurement was carried out 25° C., 1N, HCl to measure passivation current density. Results are shown in Table 1.

The corrosion-wear test was carried out by a pin-on-disk type testing machine by wearing in the solution of 0.9% NaCl at 36.5° C. Pins were machined out from each of the alloy plates, and the worn parts were spherical. The disk was made of a high density polyethylene (HDP). For the measurement of degree of wear, change in weight was measured, while for the wear volume per unit load and unit distance, specific abrasion weight was calculated. Results are shown in Table 1.

The crevice corrosion test were undertaken in that the titanium alloy plates were held at both sides by means of Teflon plates and tightened by titanium bolts and nuts, and were dipped in the solution of 10% NaCl+HCl (pH=3) at 37° C. for 500 h for observing the crevice corrosions.

The tensile tests at high speed and high temperature were performed in that those test pieces of the size of 6.0 mmϕ×16 mm after heating at 850° C. in a high frequency induction heating apparatus were subjected to the tensile test at 10 $S^{-1}$, strain rate, and the hot workability was evaluated by reduction of area. Results are shown in Table 1.

TABLE 1

| Alloy Nos. | Composition of alloys | Tensile properties Y.S. (Kgf/mm²) | T.S. | El (%) | Specific Abrasion Weight (mm²/Kg) | Passivation Current Density (μA/cm²) | Hot-workability (Reduction of area %) | Remark |
|---|---|---|---|---|---|---|---|---|
| 1 | Ti—3.0Al—2.0Mo | 54.4 | 67.1 | 22.8 | $9.3\times10^{-11}$ | 4.5 | 91 | Inventive Examples |
| 2 | Ti—5.0Al—1.5Mo | 63.0 | 74.2 | 20.2 | $7.2\times10^{-11}$ | 4.5 | 85 | |
| 3 | Ti—5.0Al—2.5Mo | 65.5 | 76.5 | 20.5 | $6.5\times10^{-11}$ | 3.8 | 83 | |
| 4 | Ti—6.0Al—2.0Mo | 68.4 | 77.0 | 20.0 | $9.2\times10^{-11}$ | 3.8 | 80 | |
| 5 | Ti—3.0Al—2.0Mo—2.0Zr | 54.0 | 66.9 | 24.8 | $7.3\times10^{-11}$ | 4.9 | 85 | |
| 6 | Ti—3.0Al—2.0Mo—6.0Zr | 69.5 | 78.9 | 18.5 | $6.5\times10^{-11}$ | 4.0 | 65 | |
| 7 | Ti—5.0Al—2.5Mo—4.0Zr | 81.5 | 91.0 | 20.2 | $5.1\times10^{-11}$ | 4.4 | 75 | |
| 8 | Ti—6.0Al—2.0Mo—2.0Zr | 71.9 | 80.7 | 19.8 | $8.5\times10^{-11}$ | 4.7 | 68 | |
| 9 | Ti—1.0Al—2.0Mo | 40.3 | 53.4 | 27.3 | $2.1\times10^{-10}$ | 5.3 | 92 | Comparative Examples |
| 10 | Ti—3.0Al—1.0Mo | 50.8 | 62.2 | 24.0 | $2.0\times10^{-10}$ | 5.7 | 90 | |
| 11 | Ti—3.0Al—4.0Mo | 59.2 | 68.2 | 14.0 | $1.7\times10^{-10}$ | 3.8 | 63 | |
| 12 | Ti—5.0Al—1.0Mo | 61.5 | 72.1 | 21.0 | $2.8\times10^{-10}$ | 5.5 | 87 | |
| 13 | Ti—5.0Al—7.0Mo | 88.2 | 93.5 | 7.9 | $1.9\times10^{-10}$ | 6.4 | 25 | |
| 14 | Ti—8.0Al—2.0Mo | 75.9 | 85.8 | 4.5 | $1.5\times10^{-10}$ | 6.1 | 32 | |
| 15 | Ti—3.0Al—2.0Mo—1.0Zr | 52.8 | 64.9 | 24.0 | $1.8\times10^{-10}$ | 4.7 | 80 | |
| 16 | Ti—3.0Al—2.0Mo—8.0Zr | 73.5 | 83.8 | 8.8 | $2.3\times10^{-10}$ | 6.3 | 42 | |
| 17 | Ti—5.0Al—1.0Mo—1.0Zr | 63.1 | 71.8 | 21.3 | $3.0\times10^{-10}$ | 5.6 | 78 | |
| 18 | Ti—5.0Al—1.0Mo—7.0Zr | 83.5 | 92.3 | 12.0 | $1.5\times10^{-10}$ | 6.3 | 50 | |
| 19 | Ti—3.0Al—5.0Mo | 59.3 | 72.2 | 22.0 | $8.2\times10^{-11}$ | 4.0 | 46 | |
| 20 | Ti—5.0Al—4.0Mo | 79.8 | 88.3 | 20.2 | $7.5\times10^{-11}$ | 4.0 | 53 | |
| 21 | Ti—3.0Al—5.0Mo—6.0Zr | 77.6 | 85.6 | 19.6 | $9.5\times10^{-11}$ | 4.1 | 32 | |
| 22 | Ti—6.0Al—4.0Mo—4.0Zr | 86.1 | 97.8 | 14.0 | $9.5\times10^{-11}$ | 4.5 | 26 | |
| 23 | Ti—6.0Al—0.5Mo—3.0Zr | 69.8 | 79.8 | 21.0 | $2.0\times10^{-10}$ | 6.5 | 80 | |
| 24 | Ti—5.0Al—4.0Mo—7.0Zr | 80.2 | 89.8 | 18.0 | $1.8\times10^{-10}$ | 5.6 | 48 | |
| 25 | Ti—6Al—4V (ELI) | 76.3 | 88.3 | 18.1 | $2.6\times10^{-10}$ | 6.0 | 65 | |
| 26 | SUS 316L | 27.0 | 55.8 | 63.4 | $6.3\times10^{-10}$ | (*) | 62 | |

(*) Passivation is destroyed, and pitting corrosion appears.

According to Table 1, the tensile properties of the inventive examples show tensile strength of more than 65 Kgf/mm² and desirable balances of strength and ductility of more than 15% (El).

With respect to the corrosion-wear properties of the inventive examples, the specific abrasion weight is not more than $1\times10^{-10}$ (mm²/Kg) being lower than the comparison examples. Especially, it is lower than Ti-6Al-4V (ELI), and the effects of the present invention are well revealed.

With respect to the corrosion resistance, it is seen from the passivation current density that the current densities of the inventive examples are smaller than those of the comparison examples and especially the inventive examples are excellent than Ti-6Al-4V (ELI).

The crevice corrosion was not found in any of the inventive alloys, and the same was also in the example ones.

In the hot working properties of the invention, as seen in the sole FIGURE, when the Al contents are almost constant and as the Mo content goes up, a reduction of area goes down in the tensile tests at the high speed and the high temperature, however, it is superior than that of Ti-6Al-4V alloy. If the Mo content is less than 1.5 wt%, the reduction of arer exceeds 70%, but as seen in Table 1, the corrosion-wear property and the corrosion resistance are lower. In the sole FIGURE, I represents the decrease in corrosion-wear properties and corrosion resistance, and II represents the decrease in hot workability. The alloy number shown in Table 1 is shown within the circles, and the alloys illustrated are those with contents of Ti of between 5 and 6%, aluminum, and molybdenum or zinc.

As is seen above, the inventive alloy has strength equivalent to that of Ti-6Al-4V alloy, and the corrosion-wear resistance and the hot workability superior thereto. It is possible to apply, as the high strength corrosion resistant titanium alloy, to industrial usage such as the hip-prosthesis of human body or the corrosion resistant material for the ocean environment.

What is claimed is:

1. A high strength and corrosion resistant titanium alloy having excellent corrosion-wear properties, consisting of Al: 4.0 to 6.0 wt%, Mo: more than 1.5 wt% to less than 3.0 wt%, Zr: 2.0 to 6.0 wt% and the balance being Ti and unavoidable impurities.

* * * * *